US010532860B2

(12) United States Patent
Hsieh

(10) Patent No.: US 10,532,860 B2
(45) Date of Patent: Jan. 14, 2020

(54) CONTAINER THAT PREVENTS AN ILLEGAL OPERATION AND CAN BE EASILY IDENTIFIED AFTER BEING ILLEGALLY OPERATED

(71) Applicant: VIGOURPLASTIC CO., LTD., Lukang Township, Changhua County (TW)

(72) Inventor: Albert Hsieh, Lukang Township, Changhua County (TW)

(73) Assignee: VIGOURPLASTIC CO., LTD., Lukang Township (TW)

( * ) Notice: Subject to any disclaimer, the term of this patent is extended or adjusted under 35 U.S.C. 154(b) by 136 days.

(21) Appl. No.: 15/864,573

(22) Filed: Jan. 8, 2018

(65) Prior Publication Data

US 2018/0127160 A1 May 10, 2018

Related U.S. Application Data

(63) Continuation-in-part of application No. 14/944,563, filed on Nov. 18, 2015, now Pat. No. 9,932,153.

(51) Int. Cl.
*B65D 43/02* (2006.01)
*B65D 55/02* (2006.01)

(52) U.S. Cl.
CPC ..... *B65D 43/0254* (2013.01); *B65D 55/02* (2013.01); *B65D 55/024* (2013.01); *B65D 2543/0062* (2013.01); *B65D 2543/00509* (2013.01); *B65D 2543/00731* (2013.01); *B65D 2543/00759* (2013.01); *B65D 2543/00842* (2013.01)

(58) Field of Classification Search
CPC .. B65D 43/0254; B65D 55/024; B65D 55/02; B65D 2543/00842; B65D 2543/00759; B65D 2543/00731; B65D 2543/00509; B65D 2543/0062
USPC ..... 220/270
See application file for complete search history.

(56) References Cited

U.S. PATENT DOCUMENTS 9,546,018 B1 * 1/2017 Vovan ..... B65D 43/0254

* cited by examiner

*Primary Examiner* — James N Smalley

(57) ABSTRACT

A container that prevents illegal operation and can be easily identified after being illegally operated, includes a bowl-shaped base and a cover selectively closing the bowl-shaped base, wherein a pre-broken structure is formed on the cover and the cover cannot be smoothly detached from the bowl-shaped base before the pre-broken structure being damaged. For the market, the salesperson easily confirms that the container has been illegally operated and the illegally operated container is replaced in time for providing fresh goods to the consumers. For consumers, the illegally operated containers can be easily confirmed and eliminated through choosing for preventing from buying unsafe or stale goods, particularly foods.

4 Claims, 8 Drawing Sheets

CONTAINER THAT PREVENTS AN ILLEGAL OPERATION AND CAN BE EASILY IDENTIFIED AFTER BEING ILLEGALLY OPERATED

CROSS-REFERENCE TO RELATED U.S. APPLICATIONS

This application is a Continuation-In-Part of application Ser. No. 14/944,563, filed Nov. 18, 2015, and entitled "Container That Prevents from an Illegal Operation and Can Be Easily Identified after Being Illegally Operated", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a container, and more particularly to a container that prevents illegal operation and can be easily identified after being illegally operated and can be reused after being legitimately operated.

2. Description of Related Art Including Information Disclosed Under 37 CFR 1.97 and 37 CFR 1.98

Vacuum-formed plastic containers are usually made to have a box-shaped or a cup-shaped containing structure and are used in supermarkets for keeping food fresh. The plastic container is transparent for the buyer to clearly see the contents, such as jelly-like, fruit or liquid foods and is provided to stimulate a customer's buying intent. For containing liquid foods, the conventional plastic containers focus on the function of a water-tight seal. The conventional plastic container usually includes a hollow body and a body for selectively closing the hollow body.

Conventional plastic containers are provided for containing instant foods. However, the conventional plastic container provides no function to stop an illegal operation. The tamper-resistant/evident structures are very important for deterring theft and preventing the loss of product and income for the seller, as well as instilling consumer confidence in the integrity of the contents within the container, and confidence in the ability of the seller and/or manufacturer to provide and maintain quality goods.

The present invention has arisen to mitigate and/or obviate the disadvantages of the conventional container used in supermarkets for containing fresh foods.

BRIEF SUMMARY OF THE INVENTION

The main objective of the present invention is to provide an improved container that prevents an illegal operation and can be easily identified after being illegally operated and can be reused after being legitimately operated.

To achieve the objective, the container in accordance with the present invention comprises a bowl-shaped base having an opening defined therein and a first locking structure surrounding the opening. A cover selectively closes the opening of the bowl-shaped base and includes a second locking structure peripherally formed thereon, wherein the first locking structure and the second locking structure are complementally and connected to each other when the cover closing the bowl-shaped base. A pre-broken structure is formed on the cover. The pre-broken structure includes a cavity defined in the cover and having an υ -shaped (upsilon) cross-section. A tongue is connected to the cover and a snapper formed on the tongue, wherein the snapper has an υ -shaped (upsilon) cross-section and is engaged into the cavity when the cover firstly closing the bowl-shaped base. A pre-broken line is formed on the tongue and surrounding the snapper such that the pre-broken line is damaged after detaching the cover from the bowl-shaped base. The pre-broken line is annular such that an annular pressing portion is formed between the snapper and the pre-broken line, and a diameter of an area, surrounded by the pre-broken line is greater than a maximum diameter of the snapper.

Further benefits and advantages of the present invention will become apparent after a careful reading of the detailed description with appropriate reference to the accompanying drawings.

DETAILED DESCRIPTION OF THE INVENTION

Figure 1:
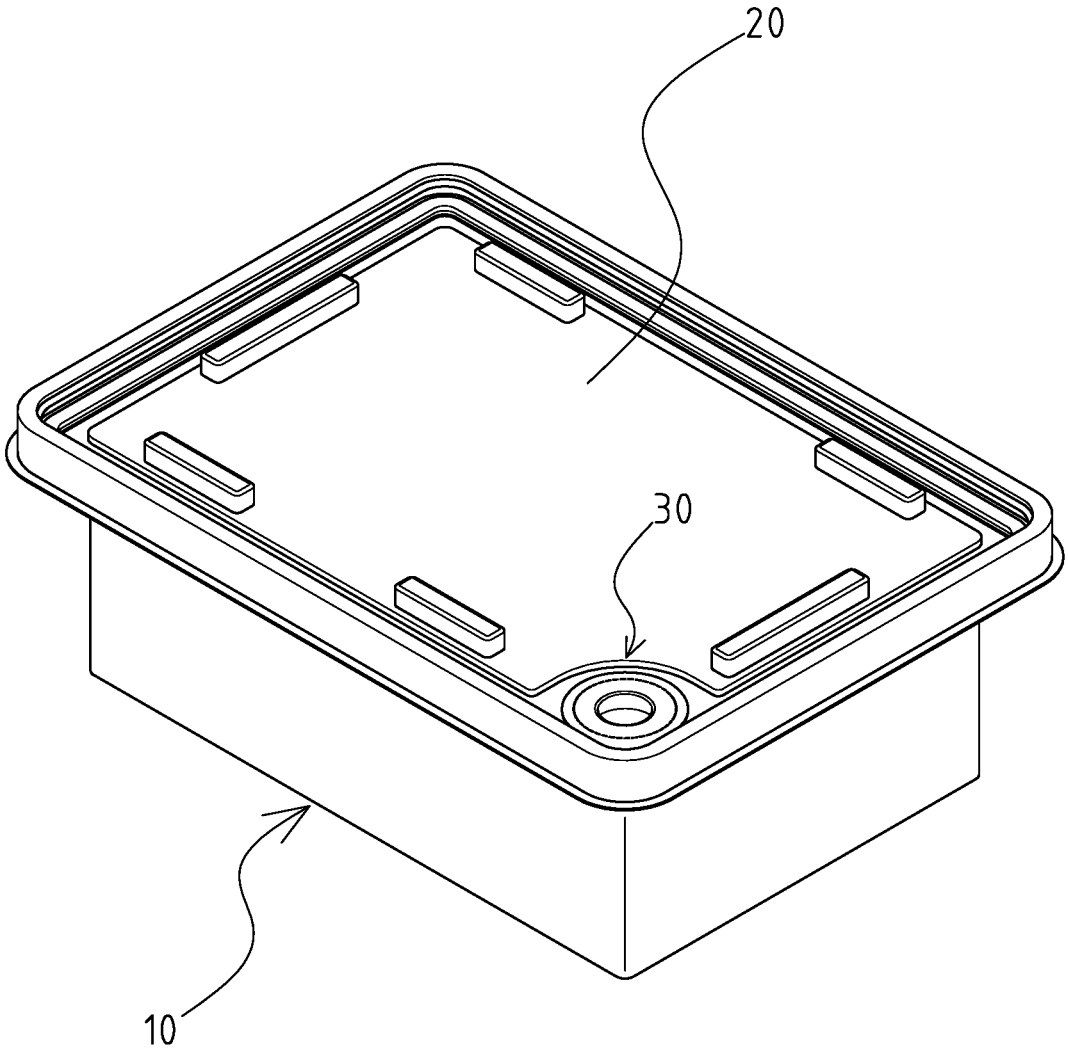
FIG. 1 is a perspective view of a container that prevents illegal operation and can be easily identified after being illegally operated and can be reused after being legitimately operated in accordance with the present invention when the bowl-shaped base is closed by the cover.
Figure 2:
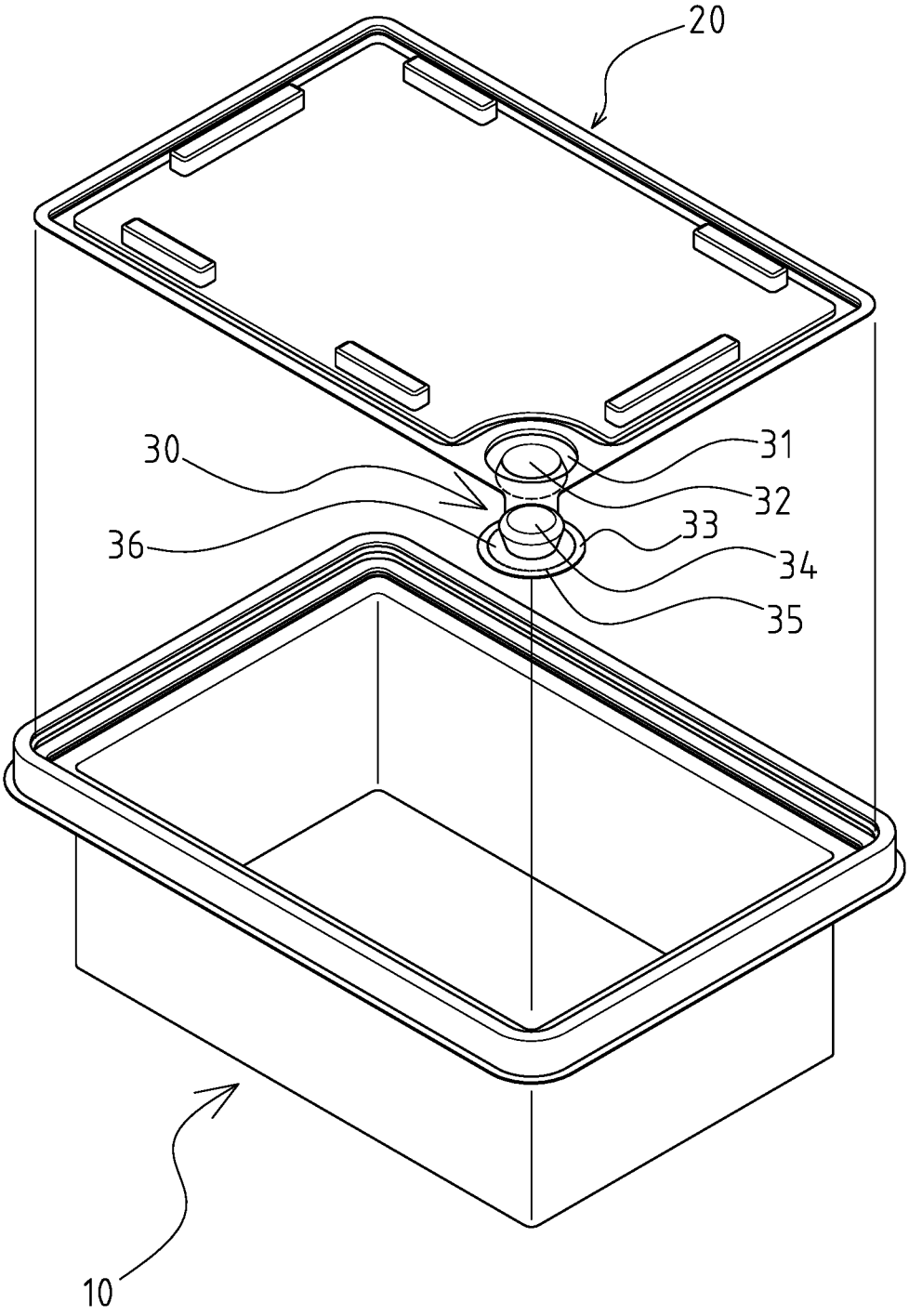
FIG. 2 is an exploded perspective view of the container in FIG. 1.

Referring to the drawings and initially to FIGS. 1-5, a container, that prevents illegal operation and can be easily identified after being illegally operated, in accordance with the present invention comprises a bowl-shaped base 10 and a cover 20 selectively closing the bowl-shaped base 10, wherein a pre-broken structure 30 is formed on the cover 20 and the cover 20 cannot be smoothly detached from the bowl-shaped base 10 before the pre-broken structure 30 being damaged. For the market, the salesperson easily confirms that the container has been illegally operated by his/her eyes and the illegally operated container is replaced in time for providing fresh good to the consumers. For the consumers, the illegally operated containers can be easily confirmed and eliminated through choosing for preventing from buying unsafe or stale goods, particularly foods.

The bowl-shaped base 10 has an opening (not numbered) defined therein and a stair-shaped first locking structure 11 surrounding the opening. The first locking structure 11 is sequentially divided into a vertical portion 111 and a horizontal portion 112, wherein a first locking portion 12 is peripherally formed on the vertical portion 111. A peripheral wall 13 outwardly extends from an edge of the horizontal portion 112 of the first locking structure 11 and surrounds the cover 20. The peripheral wall 13 has a rib 131 peripherally formed thereon. A first protrusion 14 laterally extends from the horizontal portion 112 of the first locking structure 11.

The cover 20 is provided to selectively close the opening in the bowl-shaped base 10 and the peripheral wall 13 surrounds the cover 20. The cover 20 includes a stair-shaped second locking structure 21 peripherally formed thereon. The first locking structure 11 and the second locking structure 21 are complementally and air-tightly connected to each other when the cover 20 closing the bowl-shaped base 10. The second locking structure 21 is sequentially divided into a vertical portion (not numbered) and a horizontal portion (not numbered), wherein a second locking portion 22 is peripherally formed on the vertical portion of the second locking structure 21, and the second locking portion 22 is complementally and selectively connected to the first locking portion 12 when the cover 20 closing the bowl-shaped base 10.

The pre-broken structure 30 includes a recess 31 defined in the cover 20 and a cavity 32 defined in a bottom of the recess 31, wherein the cavity 32 has an υ -shaped (upsilon) cross-section. A tongue 33 is connected to the cover 20 and a snapper 34 is formed on the tongue 33, wherein the snapper 34 has an υ -shaped (upsilon) cross-section. The snapper 34 is engaged into the cavity 32 when the cover 20 firstly closing the bowl-shaped base 10. A pre-broken line 35 is formed on the tongue 33 and surrounds the snapper 31, wherein the pre-broken line 35 is annular such that an annular pressing portion 36 is formed between the snapper 34 and the pre-broken line 35. In the preferred embodiment of the present invention, the recess 31 is round and coaxially corresponds to the pre-broken line 35, wherein a diameter of an area, surrounded by the pre-broken line 35 is smaller than that of the recess 31 and the diameter of an area, surrounded by the pre-broken line 35 is greater than a maximum diameter of the snapper 34. With reference to FIG. 4A, a distance H between the snapper 34 and the bottom of the cavity 32 is not less than a deepness D of the recess 15.

Figure 4:
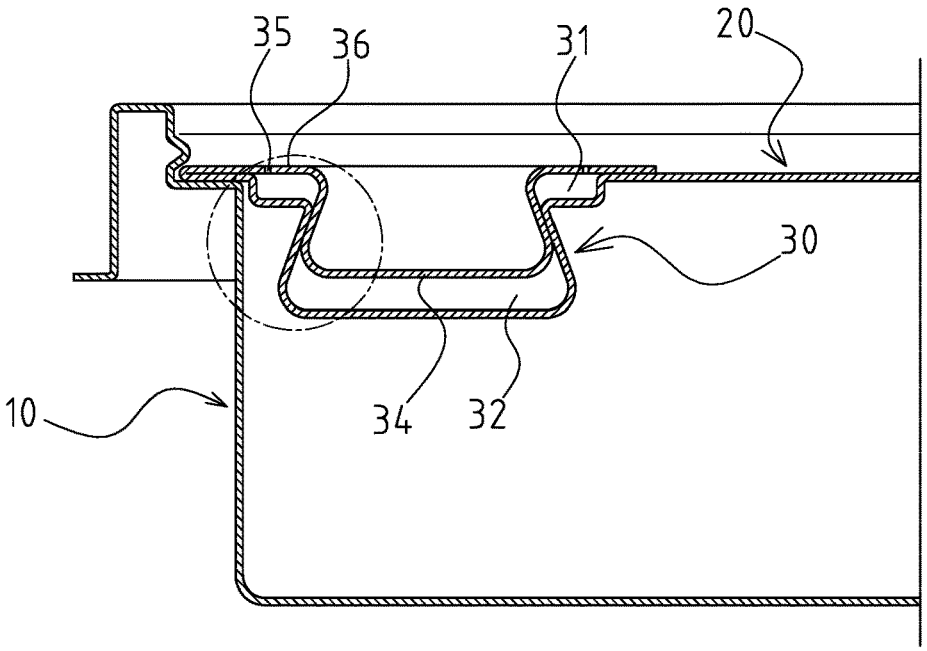
FIG. 4 is a cross-sectional view of the container along the line 4-4 in FIG. 3.
Figure 4A:
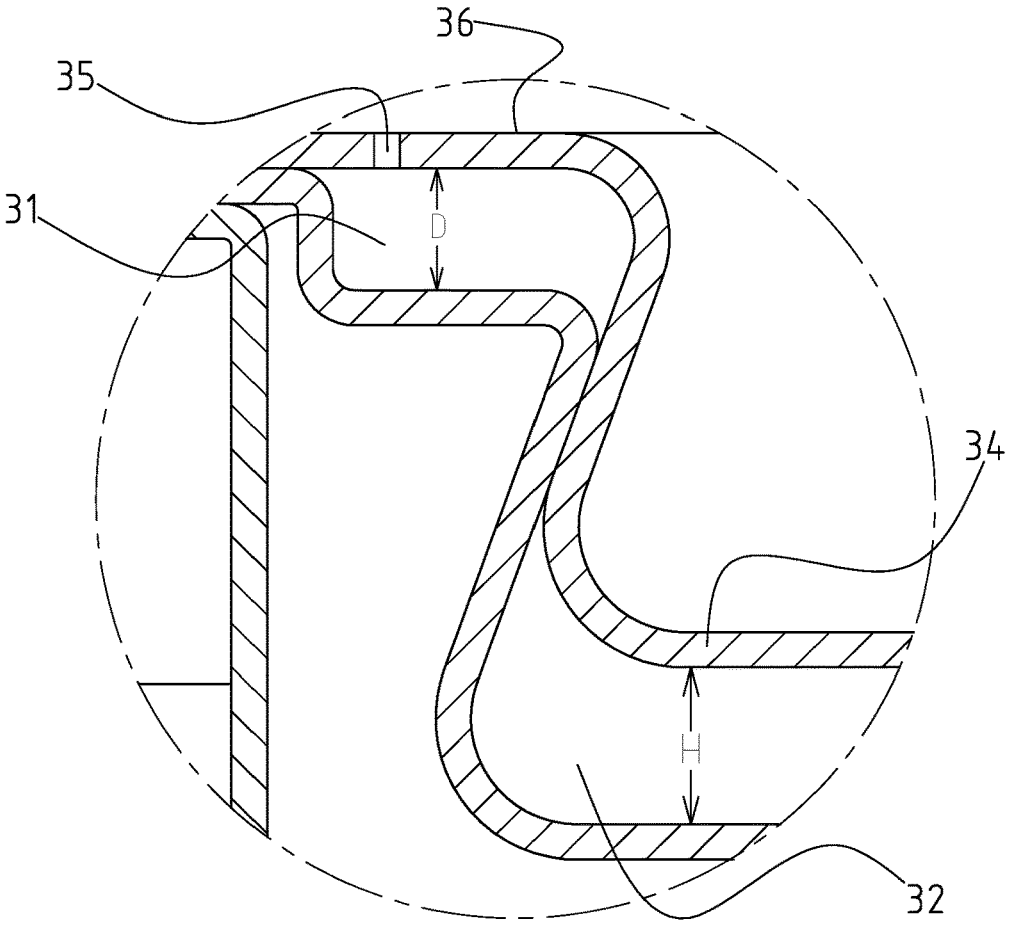
FIG. 4A is a partially enlarged view of FIG. 4.
Figure 5:
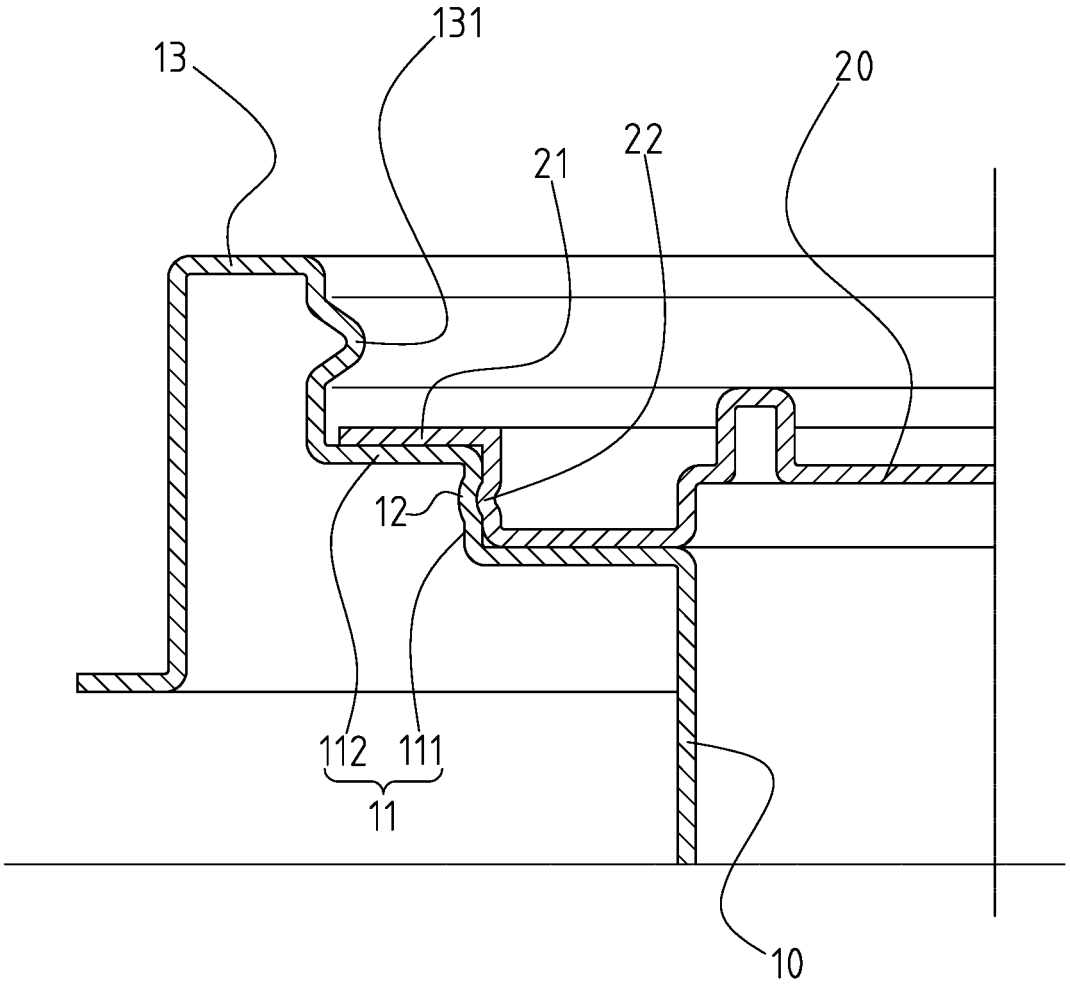
FIG. 5 is a cross-sectional view of the container along the line 5-5 in FIG. 3.
Figure 6:
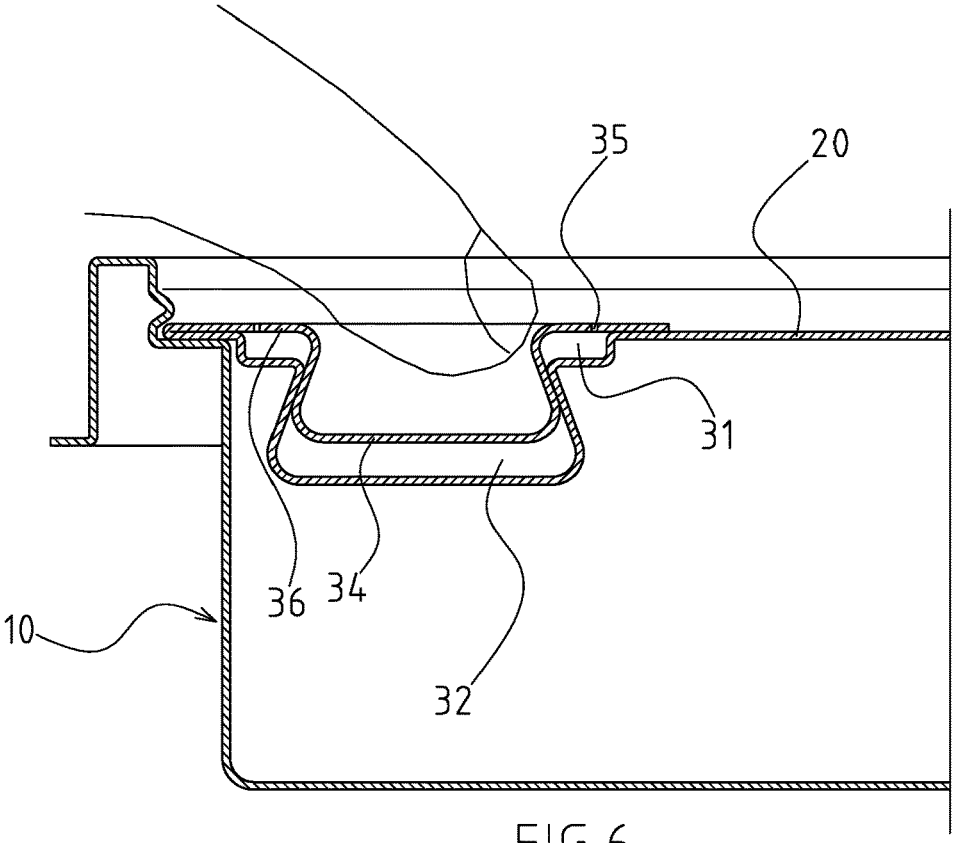
FIGS. 6 and 7 are operational views of the container in accordance with the present invention when tearing the pre-broken line.
Figure 7:
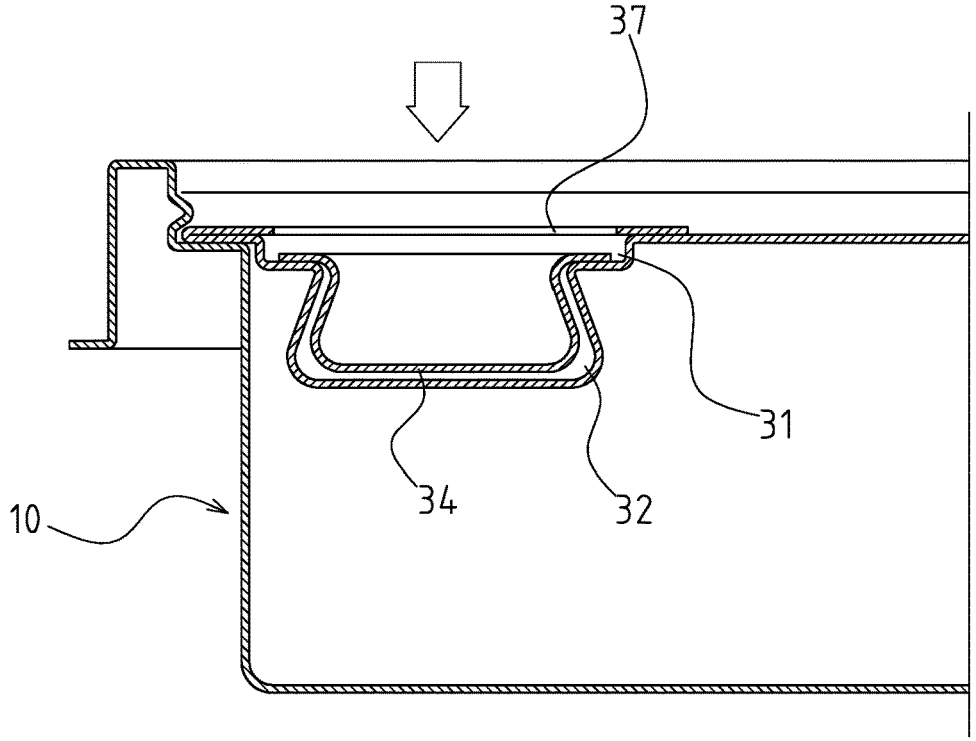

With reference to FIGS. 4 and 5, the horizontal portion 112 of the first locking structure 11 abuts the horizontal portion of the second locking structure 21, and an edge of the horizontal portion of the second structure 21 extends toward an abutment between the peripheral wall 13 and the horizontal portion 112 of the first locking structure 11 when the cover 20 firstly closing the bowl-shaped base 10. In addition, the first locking portion 12 and the second locking portion 22 are engaged to each other, and the snapper 31 of the pre-broken structure 30 is napped into the cavity 16 to hold the cover 20 in place and air-tightly close the bowl-shaped base 10. By such a manner, the cover 20 is hard to be detached from the bowl-shaped base 10 without damaging the pre-broken structure 30 because the fingertip of the gangster will be blocked by the peripheral wall 13 and the nail of the gangster can hook the edge of the horizontal portion of the second locking structure 21 when he/she wants to upwardly pick the edge of the horizontal portion of the second locking structure 21. In addition, the rib 131 on the peripheral wall 13 can prevent the edge of the horizontal portion of the second locking structure 21 from being pried by using a slim stick. Consequently, the salesperson can easily confirm that the container has been illegally operated and the illegally operated container is replaced in time for providing fresh good to the consumers and the illegally operated containers can be easily confirmed and eliminated through choosing by the consumers for preventing from buying unsafe or stale goods.

Figure 3:
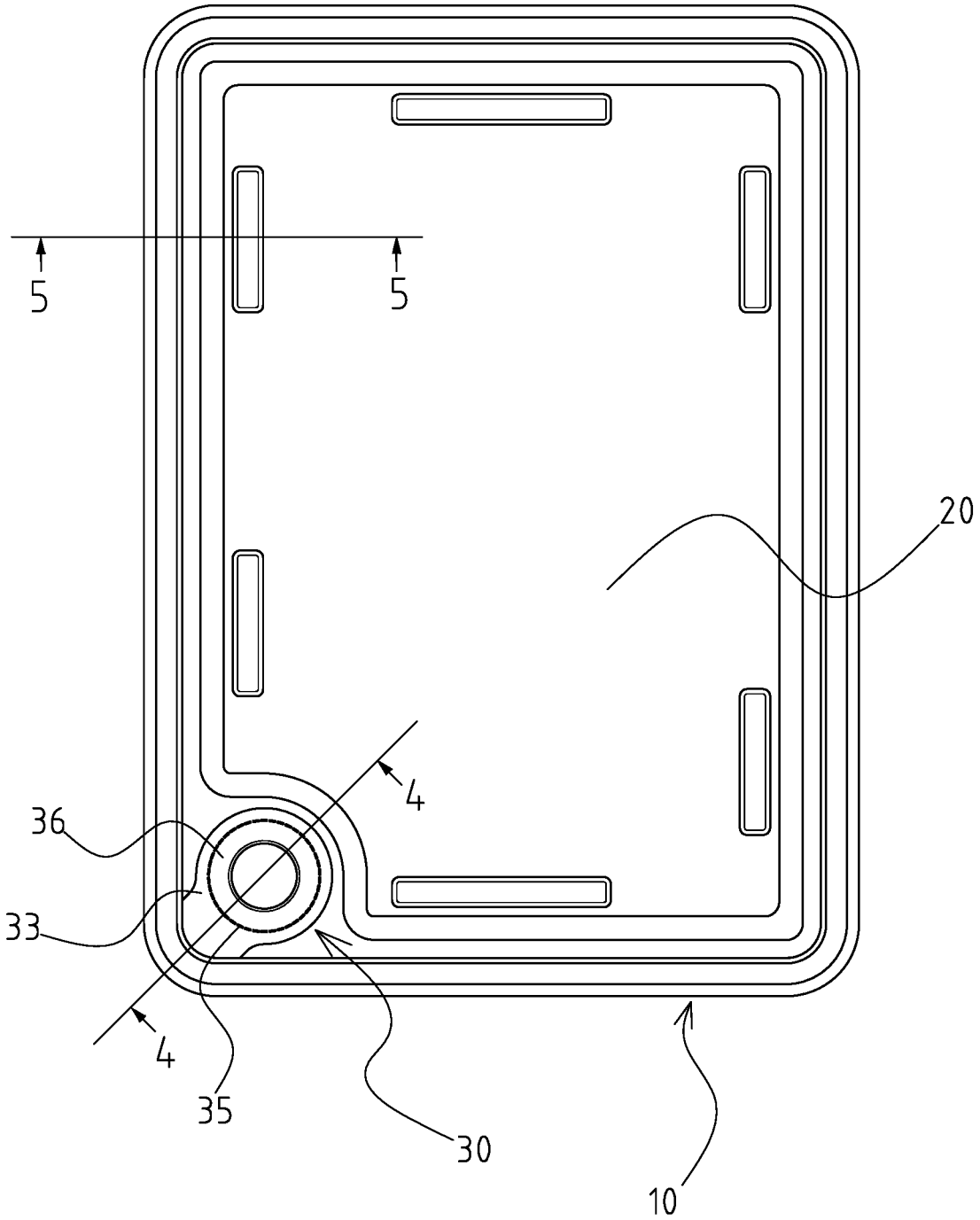
FIG. 3 is a top plan view of the container in FIG. 1.
Figure 3A:
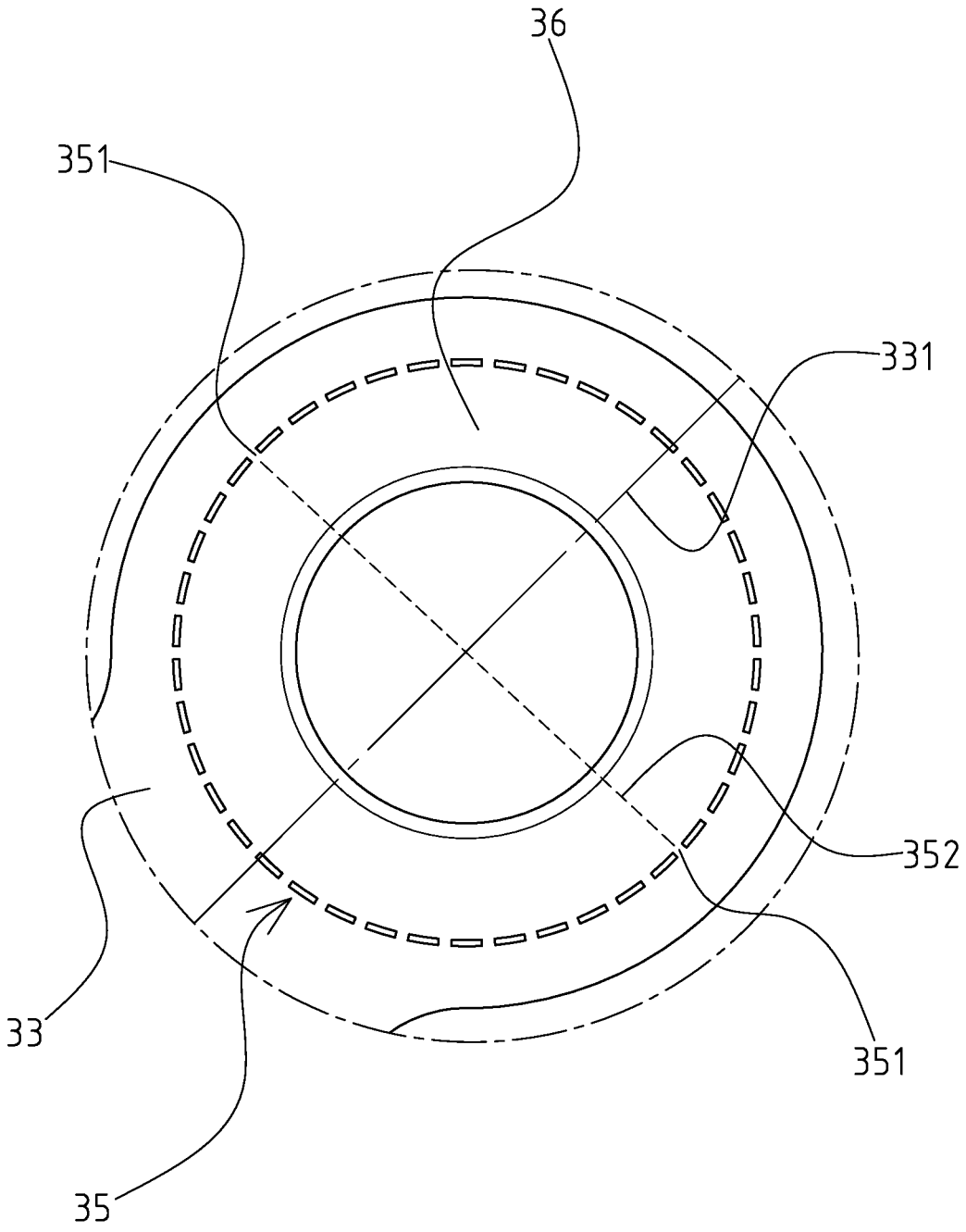
FIG. 3A is a partially enlarged view of FIG. 3.
Figure 8:
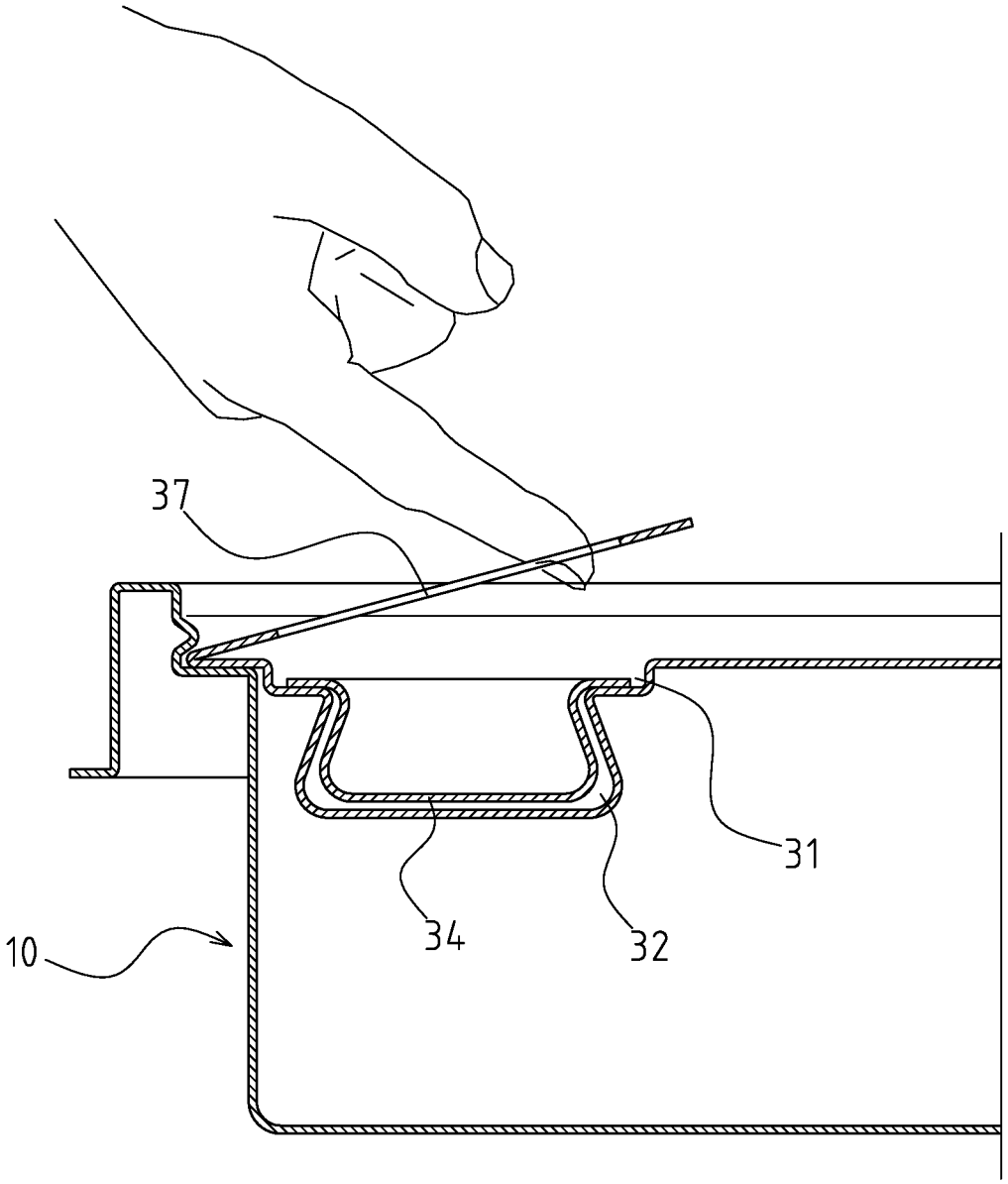
FIG. 8 is an operational view of the container in accordance with the present invention when detaching the cover from the bowl-shaped base.

With reference to FIGS. 3A, 4, 4A, 6 and 7, the consumer only needs to press the pressing portion 36 between the snapper 34 and the pre-broken line 35 and damage the pre-broken line 35 when opening the cover 20 at home. A part, formed by the pre-broken line 35 of the tongue 33 falls down with the snapper 34 to define a through hole 37 because the distance H between the snapper 34 and the bottom of the cavity 32 is not less than the deepness D of the recess 31. As a result, the operator can easily upwardly lift and open the cover 20 by hooking the edge of the through hole 37 and the tongue 33 is lifted along an operational line 331, as shown in FIGS. 3A and 8. Furthermore, the cover 20 can repeatedly bowl-shaped base 10 due to the first locking structure 11 and the second locking structure 21 such that the opened container in accordance with the present invention can be reused. With reference to FIG. 4A, the pressing portion 36 is flat and the diameter of an area, surrounded by the pre-broken line 35 is greater than a maximum diameter of the snapper 34. Accordingly, the diameter of the pressing portion 36 is enlarged. As a result, the fingertip of the operator does not directly contact with an edge of the through hole 37 to prevent the fingertip from pain. In addition, the tongue 33 completely abuts the cover 20 due to the recess 31 when the snapper 34 is snapped into the cavity 32 to prevent the tongue 33 from an accident operation that tears the pre-broken line 35. As a result, the pre-broken structure 30 guides the operator to detaching the cover 20 after tearing the pre-broken line 36 by pressing the pressing portion 36.

With reference to FIG. 3A, the operational line 331 of the tongue 33 divides the annular pre-broken line 35 into a first semicircle portion and a second semicircle portion, wherein each semicircle portion has multiple connecting portions 351. Each connecting portion 351 of the first semicircle portion aligns with a corresponding one of the multiple connecting portions 351 of the second semicircle portion and a connecting line 352 of the aligned connecting portions 351 is vertical relative to the operational line 331 of the tongue 33 such that the tongue 33 is upwardly curved after being operated.

Although the invention has been explained in relation to its preferred embodiment, it is to be understood that many other possible modifications and variations can be made without departing from the spirit and scope of the invention as hereinafter claimed.

I claim:

1. A container that prevents tampering and in which the tampering can be detected and which can be reused when not tampered with, the container comprising:

a bowl-shaped base having an opening defined therein and a first locking structure surrounding the opening;

a cover selectively closing the opening of said bowl-shaped base and having a second locking structure peripherally formed thereon, wherein the first locking structure and the second locking structure are complementary to each other and connected to each other when said cover closes the bowl-shaped base; and a pre-broken structure formed on said cover, the pre-broken structure having a cavity defined in said cover and having an υ-shaped (upsilon) cross-section, wherein a tongue is connected to said cover and a snapper formed on the tongue, wherein the snapper has an υ-shaped (upsilon) cross-section and is engaged into the cavity when the cover closes the bowl-shaped base, wherein a pre-broken line is formed on the tongue and surrounds the snapper, wherein the pre-broken line is annular such that an annular pressing portion is formed between the snapper and the pre-broken line and such that the pre-broken line is damaged after detaching the cover from the bowl-shaped base, and wherein a diameter of an area surrounded by the pre-broken line is greater than a maximum diameter of the snapper, wherein said pre-broken structure has a recess defined in said cover and the cavity is defined in a bottom of the recess and wherein a distance between the snapper and a bottom of the cavity is not less than a depth of the recess, wherein the recess is round and co-axially corresponds to said pre-broken line, and wherein a diameter of an area surrounded by said pre-broken line is less than a diameter of the recess.

2. The container of claim 1, wherein the tongue is liftable along an operational line when the cover is opened, the operational line of the tongue dividing the pre-broken line into a first semicircular portion and a second semicircular portion, wherein each of the first and second semicircular portions has multiple connecting portions, each of the multiple connecting portions of the first semicircular portion aligning with a corresponding one of the multiple connecting portions of the second semicircular portion and a connecting line of the aligned connecting portions being vertical relative to the operational line of the tongue such that the tongue is upwardly curved after being lifted.

3. The container of claim 1, wherein the first locking structure is sequentially divided into a vertical portion and a horizontal portion, the second locking structure being sequentially divided into a vertical portion and a horizontal portion, wherein a first locking portion is peripherally formed on the vertical portion of the first locking structure and a second locking portion is peripherally formed on the vertical portion of the second locking structure, wherein the second locking portion is complementarily and selectively connected to the first locking portion when the cover closes the bowl-shaped base.

4. The container of claim 3, wherein a peripheral wall extends outwardly from an edge of the horizontal portion of the first locking structure and surrounds the cover, the peripheral wall having a rib peripherally formed thereon so as to prevent an edge of the horizontal portion of the second locking structure from being pried with a stick.

* * * * *